US005288940A

United States Patent [19]

Izumisawa

[11] Patent Number: 5,288,940

[45] Date of Patent: Feb. 22, 1994

[54] TONE GENERATING CIRCUITRY FOR READING OUT ONE-SHOT AND SUSTAINING WAVEFORMS

[75] Inventor: Gen Izumisawa, Hamamatsu, Japan

[73] Assignee: Kabushiki Kaisha Kawai Gakki Seisakusho, Hamamatsu, Japan

[21] Appl. No.: 4,386

[22] Filed: Jan. 14, 1993

Related U.S. Application Data

[63] Continuation of Ser. No. 835,171, Feb. 13, 1992, abandoned.

[30] Foreign Application Priority Data

Feb. 15, 1991 [JP] Japan ..... 3-042423

[51] Int. Cl.[5] ..... G10H 1/057; G10H 1/46; G10H 7/02

[52] U.S. Cl. ..... 84/603; 84/604; 84/627; 84/633

[58] Field of Search ..... 84/603-607, 84/627, 633, 663, 665, 702, 703, 711

[56] References Cited

U.S. PATENT DOCUMENTS 4,263,828 4/1981 Aoki et al. ..... 84/702
4,573,389 3/1986 Suzuki ..... 84/605
4,947,723 8/1990 Kawashima et al. ..... 84/603

*Primary Examiner*—Stanley J. Witkowski
*Attorney, Agent, or Firm*—Joseph C. Mason, Jr.; Ronald E. Smith

[57] ABSTRACT

A tone generating apparatus which comprises a wave memory in which first tone waveform data with a preselected length extracted from an attack portion of a musical tone and second tone waveform data with a preselected length following the first tone waveform data and having a value of zero are stored. A read circuit reads the first tone waveform data only once from the wave memory and subsequently reads the second tone waveform data repeatedly. A tone generator generates a musical tone based on the tone waveform data read out by the read circuit. In reading out tone waveform data from the wave memory, the first tone waveform data is read out first, followed by repetitive reading of only the second tone waveform data.

Repetitive reading of the second tone waveform data produces no sound because the contents of the second tone waveform data are zero. Thus, this system performs a function equivalent to tone release effected by reading out a one-shot waveform.

6 Claims, 8 Drawing Sheets

TONE GENERATING CIRCUITRY FOR READING OUT ONE-SHOT AND SUSTAINING WAVEFORMS

This is a continuation of copending U.S. patent application(s) Ser. No. 07/835,171 filed on Feb. 13, 1992 and now abandoned.

BACKGROUND OF THE INVENTION

1. Field of the Invention

The present invention relates to a tone generating apparatus for use in electronic musical instruments, such as a synthesizer, an electronic piano, an electronic organ, and a single keyboard. More particularly, this invention pertains to an arrangement that permits easy reading of a one-shot waveform in a tone generating apparatus, which reads out tone waveform data from a wave memory to generate a tone signal.

2. Description of the Related Art

In general, a tone generating apparatus (sound source) for use in an electronic musical instrument includes a wave memory in which plural types of tone waveform data corresponding to multifarious types of timbres are provided. In tone generation, tone waveform data in the wave memory which corresponds to a timbre specified by, for example, a panel switch or the like, is selected and is read out at a speed corresponding to a key (i.e., pitch) to produce a tone signal, and this tone signal is supplied to an acoustic circuit to generate a musical tone.

Since the capacity of the wave memory to store tone waveform data is limited, various methods are considered to store tone waveform data in compressed form.

For instance, there is a method which, with respect to one timbre, stores tone waveform data for the attack portion of a musical tone and tone waveform data for the sustain portion of that musical tone separately in the wave memory. With the tone waveform data stored in this method, when tone generation is instructed, the tone waveform data for the attack portion of a musical tone is read out only once, followed by repetitive reading of the tone waveform data for the sustain portion of that musical tone, to produce associated tone signals in order to acquire a predetermined musical tone.

This method can reproduce at high fidelity an intricate and delicate sound contained in the attack portion of a musical tone as well as can produce the sound of the sustain portion of that musical tone with fewer pieces of tone waveform data, while ensuring data compression.

Not every musical tone to be produced by an electronic musical instrument or the like has the aforementioned sustaining sound, but there are not a few cases of non-repeated and only one tone generation in a short period. The latter tone generation is accomplished by reading tone waveform data from the wave memory, from the top to the end, only once, (this way of reading out tone waveform data will hereinafter be called "one-shot waveform reading").

In order to manage the above two reading methods, therefore, a conventional tone generating apparatus has separate circuits for reading out tone waveform data to generate a sustaining sound and for reading out a one-shot waveform.

This complicates the structure of the tone generating apparatus and increases the cost thereof.

SUMMARY OF THE INVENTION

It is therefore an object of the present invention to provide a tone generating apparatus which uses a common circuit to read out tone waveform data for generation of a sustaining sound and read out a one-shot waveform, so that the apparatus can be manufactured with fewer circuits, resulting in cost reduction.

To achieve this object, a tone generating apparatus according to the present invention comprises a wave memory in which first tone waveform data with an arbitrary length extracted from an attack portion of a musical tone and second tone waveform data with an arbitrary length following the first tone waveform data and having a value of zero are stored; a read circuit for reading the first tone waveform data only once from the wave memory and subsequently reading the second tone waveform data repeatedly; and a tone generator for generating a musical tone based on the tone waveform data read out by the read circuit.

According to the present invention, in storing tone waveform data into the wave memory, a tone portion with an arbitrary length is extracted from the attack portion of a musical tone as first tone waveform data, tone waveform data with an arbitrary length, which follows the first tone waveform data and has an output of zero when read out for tone generation, is treated as second tone waveform data, and these first and second tone waveform data are stored in the named order in the wave memory.

To read out tone waveform data from the wave memory, the first tone waveform data is read out first, followed by repetitive reading of only the second tone waveform data.

Although this operation is the same as the one executed in reading out loop waveform data to produce a normal sustaining sound, repetitive reading of this waveform data will produce no sound, because the contents of the second tone waveform data are zero. In other words, this operation can achieve a function equivalent to tone release effected by reading out a one-shot waveform.

Therefore, a circuit for reading out tone waveform data to provide a sustaining sound and a circuit for reading out a one-shot waveform can be accomplished by a single common circuit, thus eliminating the need for the latter circuit. The amount of hardware required for a tone generating apparatus can therefore be reduced.

DETAILED DESCRIPTION OF THE PREFERRED EMBODIMENTS

Figure 1:
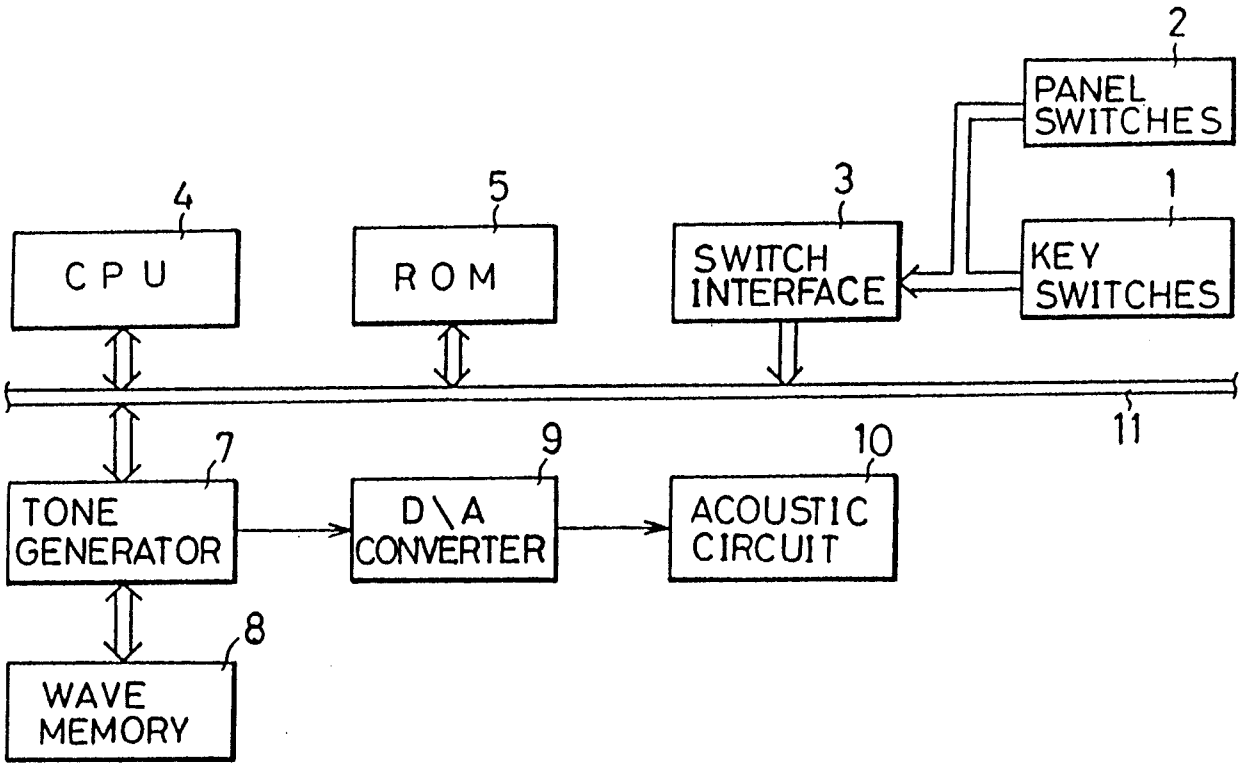
FIG. 1 is a block diagram schematically illustrating the general structure of an electronic musical instrument to which the present invention is applied.

FIG. 1 presents a schematic block diagram illustrating the general structure of an electronic musical instrument to which a tone generating apparatus embodying the present invention is applied.

Referring to FIG. 1 key switches 1 include multiple key switches which are open or closed upon releasing or depression of associated keys, and a key scan circuit for detecting the open/close status of each key switch. Signals from the key scan circuit in the key switches 1 are supplied to a switch interface 3.

Panel switches 2 include various switches such as a mode designate switch, a melody select switch, a rhythm select switch. The set status of each panel switch is detected by a panel scan circuit included in the panel switches 2, as is done by the key scan circuit in the key switches 1. Signals from the panel scan circuit in the panel switches 2 are also sent to the switch interface 3.

The switch interface 3 receives signals from the key scan circuit in the key switches 1 and from the panel scan circuit in the panel switches 2, and outputs data from the panel switches in the ON status, a key code and touch data for a key newly depressed, and a key code for a key newly released. The signals from the switch interface 3 are sent via a system bus 11 to a CPU (Central Processing Unit) 4.

The touch data is generated by a well-known touch detector (not shown).

The CPU 4 controls each section of the electronic musical instrument in accordance with a control program which is stored in a program memory section in a read only memory (ROM) 5. The CPU 4 accesses the ROM 5 through the system bus 11.

The ROM 5 contains timbre data and other various types of fixed data, in addition to the control program for operating the CPU 4.

A tone generator 7, which directly relates to the feature of the present invention, is connected to a wave memory 8. The wave memory 8 serves to store tone waveform data corresponding to various timbres. The tone generator 7 and the wave memory 8 will be described in detail later.

The switch interface 3, the CPU 4, the ROM 5 and the tone generator 7 are connected to one another by the system bus 11.

A digital tone signal from the tone generator 7 is sent to a D/A converter 9. The D/A converter 9 converts a received digital tone signal to an analog signal. This analog signal is supplied to an acoustic circuit 10.

The acoustic circuit 10 is of a known type which converts the received analog signal (electric signal) into an acoustic signal. The acoustic circuit 10 may be realized by loudspeakers, a headphone or the like.

Figure 2A:
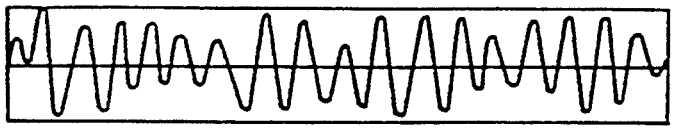
FIG. 2A is a diagram of pulse code modulation waveform data.
Figure 2B:
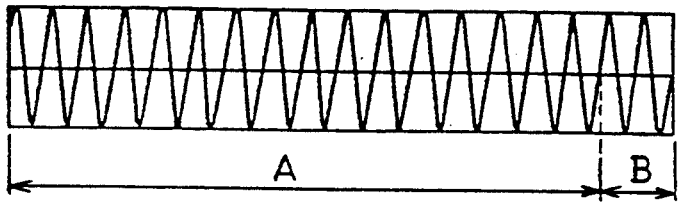
FIG. 2B is a diagram showing a normalized envelope.
Figure 2C:
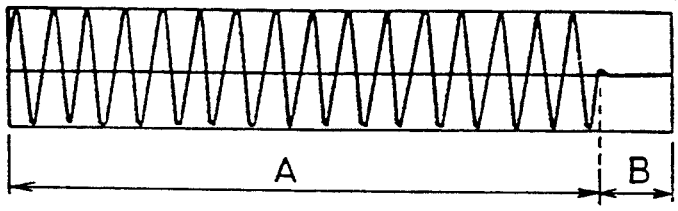
FIG. 2C is a diagram showing interval B of the normalized envelope of FIG. 2B set to zero.

FIGS. 2A to 2C are diagrams illustrating processes of producing tone waveform data to be stored in the wave memory 8. The tone waveform data is produced as follows.

FIG. 2A shows PCM (Pulse Code Modulation) waveform data which becomes original waveform data (original data). This PCM waveform data is digital data acquired by A/D conversion of an analog tone signal which is the original tone.

Then, when the PCM waveform data represents waveform data of an attenuating sound such as a piano sound, an envelope is normalized as shown in FIG. 2B. That is, the PCM waveform data is converted into tone waveform data having a constant amplitude.

The normalized tone waveform data is then divided into two parts at an arbitrary position, a predetermined interval (interval A) from the attack of a musical tone treated as tone waveform data that is to be read out once, while a predetermined interval (interval B) for the remaining end portion is treated as an interval that is to be repeatedly read out. As shown in FIG. 2C, a predetermine length (interval B) of the end portion of the tone waveform data is then made zero. The tone waveform data produced through the individual steps as shown in FIGS. 2A to 2C is to be stored in the wave memory 8.

An address where head data of the interval B is stored is called "loop-top address LT" and an address where the end data of the interval B is stored is called "loop-end address LE." Address data representing the loop-top address LT and one representing the loop-end address LE are stored in association with tone waveform data in the ROM 5.

Figure 2D:
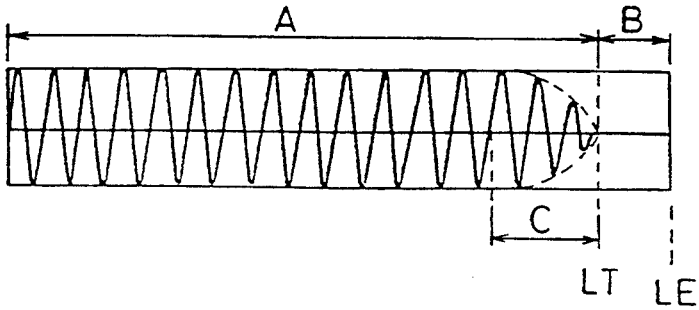
FIG. 2D is a diagram showing interval C of said normalized envelope altered to have the depicted attenuating property.

In storing tone waveform data in the wave memory 8, a predetermined length C of the end portion of the interval A of tone waveform data may be altered to have an attenuating property as shown in FIG. 2D. This processing can suppress noise which occurs in transition from the tone-ON state to the tone-OFF state at the time of reading out a one-shot waveform, thereby ensuring smoother transition.

Figure 3:
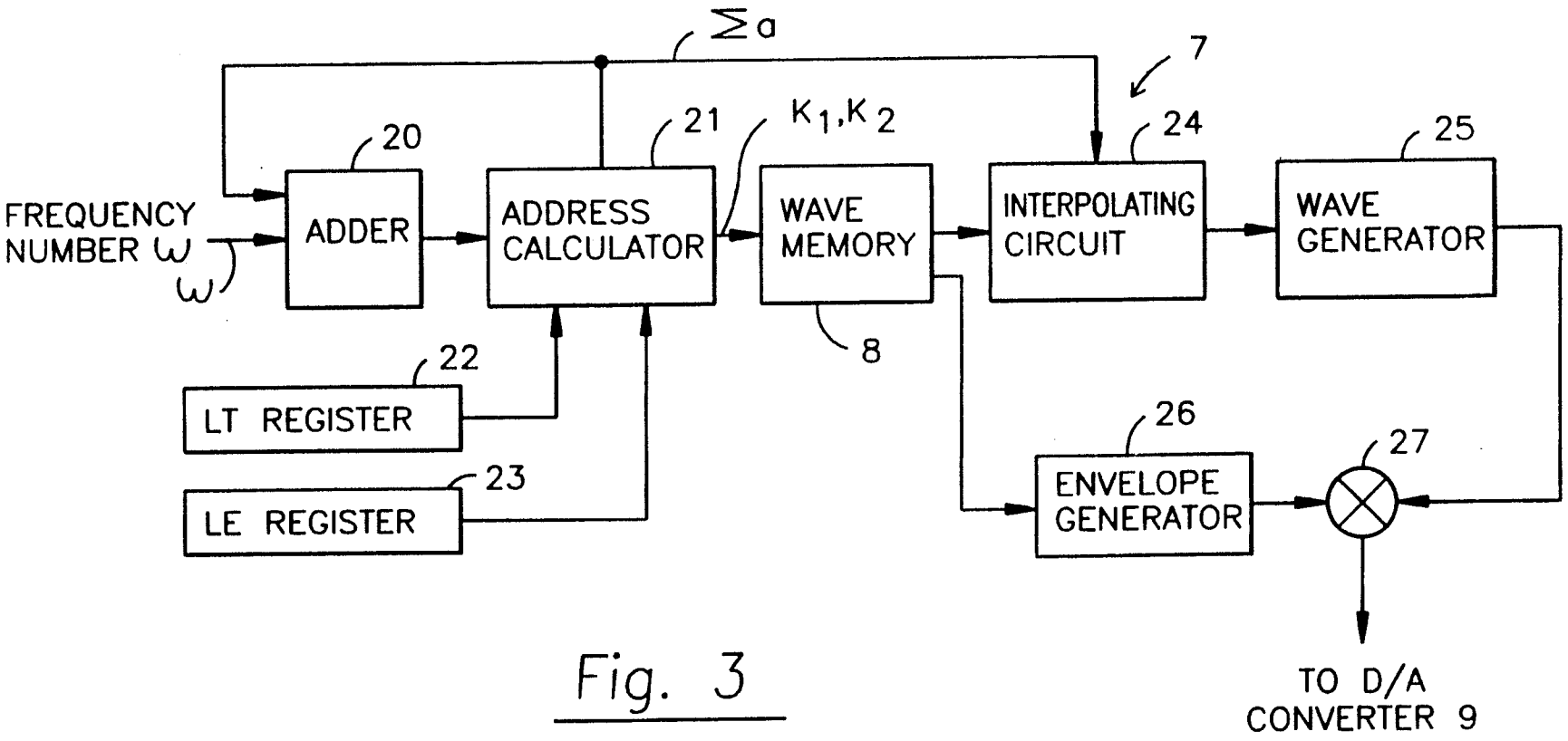
FIG. 3 is a detailed block diagram illustrating a wave memory and a tone generator according to this embodiment of the present invention.

FIG. 3 is a detailed block diagram illustrating the tone generator 7 and the wave memory 8.

Referring to FIG. 3 the detailed structure of the tone generator 7 will now be described. The following description will be given on the premise that envelope data for producing an envelope signal as well as the aforementioned tone waveform data are stored in the wave memory 8.

In FIG. 3 an adder 20 adds a current read address $\Sigma a$ computed in an address calculator 21 to a frequency number $\omega$ which is sent from the CPU 4, both items having values containing a fraction portion.

The frequency number $\omega$ serves to give an increment of a read address at the time tone waveform data is sequentially read out from the wave memory 8. This frequency number $\omega$ has different values in association with key codes. In other words, the frequency number $\omega$ takes a large value for a key code corresponding to a high pitched tone while having a small value for a key code corresponding to a low pitched tone. Pseudo alteration of the speed of reading out data from the wave memory 8 is accomplished by reading tone waveform data by an increment corresponding to this frequency number $\omega$.

The result of the addition done in the adder 20 is supplied to the address calculator 21.

An LT register 22 holds a loop-top address from the CPU 4. The contents of the LT register 22 are supplied to the address calculator 21.

An LE register 23 holds a loop-end address from the CPU 4. The contents of the LE register 23 are also supplied to the address calculator 21.

The address calculator 21 computes a read address to be given to the wave memory 8. The address calculator 21 produces an address for reading tone waveform data from the top only once, and an address for repeatedly reading tone waveform data within the range defined by the address values set in the LT register 22 and LE register 23.

The address calculator 21 sends a read address integer portion $K_1$ or an integer portion of read address $\Sigma a$ to the wave memory 8. The address calculator 21 also computes an interpolation integer address $K_2$ acquired by adding "1" to the read address integer portion $K_1$, and sends it to the wave memory 8. The read address $\Sigma a$ containing a fraction portion is supplied to an interpolating circuit 24 besides the adder 20.

The interpolating circuit 24 performs interpolation on the tone waveform data read out from the wave memory 8 using the read address integer portion $K_1$ and the tone waveform data read out from the same memory 8 using the interpolation integer address $K_2$ in accordance with the fraction portion of the read address $\Sigma a$, and then supplies the resultant data to a wave generator 25.

In other words, when the computed read address $\Sigma a$ contains a fraction portion, the interpolating circuit 24 computes a value to be the storage content at the read address $\Sigma a$ in accordance with the difference (inclination) between values stored respectively at the read address integer portion $K_1$ and interpolation integer address $K_2$, two integers preceding and following that read address $\Sigma a$, and supplies the computed value as the value of tone waveform data to the wave generator 25.

The wave generator 25 produces a tone waveform signal based on the data from the interpolating circuit 24, and supplies it to a multiplier 27.

An envelope generator 26 generates an envelope signal based on envelope data read out from the wave memory 8, and supplies it to the multiplier 27.

The multiplier 27 multiplies the tone waveform signal from the wave generator 25 by the envelope signal from the envelope generator 26 to produce a tone signal having the envelope signal added thereto. This tone signal is converted by the D/A converter 9 into an analog signal, which is in turn released from the acoustic circuit 10 (see FIG. 1).

The operation of this embodiment of the present invention with the above-described structure will be described below referring to the flowcharts, shown in FIGS. 4 and 5.

In general there are two ways of reading out tone waveform data from the wave memory for tone generation, "normal reading" and "alternate reading."

Figure 7A:
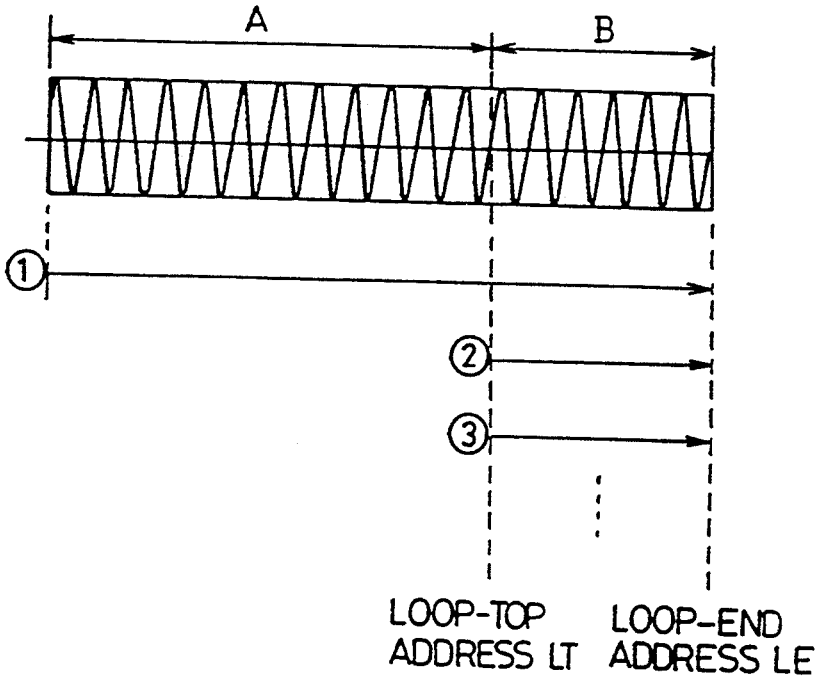
FIG. 7A is a diagram indicating a first method for reading out tone waveform data.

As shown in FIG. 7A, the normal reading is to read out an interval A, which is to be read out once from the top of tone waveform data, and an interval B, which is to be repeatedly read out, consecutively one time (indicated by ① in the diagram), and then repetitively read out only the interval B in one direction after the former reading is completed (indicated by ②,③,...). In this manner a sustaining tone signal is produced.

Figure 7B:
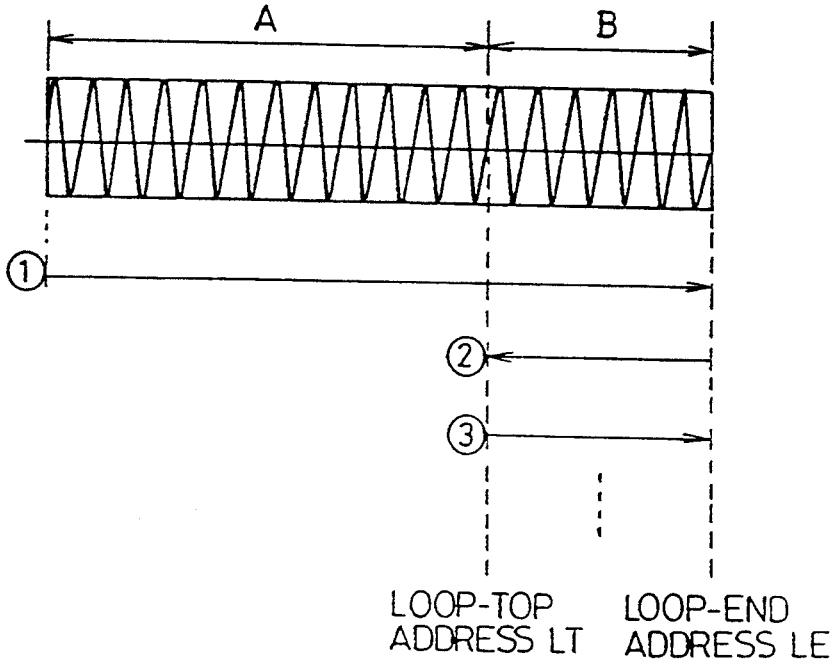
FIG. 7B is a diagram showing a second method for reading out tone waveform data.

As shown in FIG. 7B, the alternate reading is to read out an interval A, which is to be read out once from the top of tone waveform data, and an interval B, which is to be repeatedly read out consecutively one time (indicated by ① in the diagram), and then repetitively read out only the interval B in alternate first and second directions after the former reading is completed (indicated by ②,③,...). In this manner a sustaining tone signal like the one mentioned above is produced.

Figure 4:
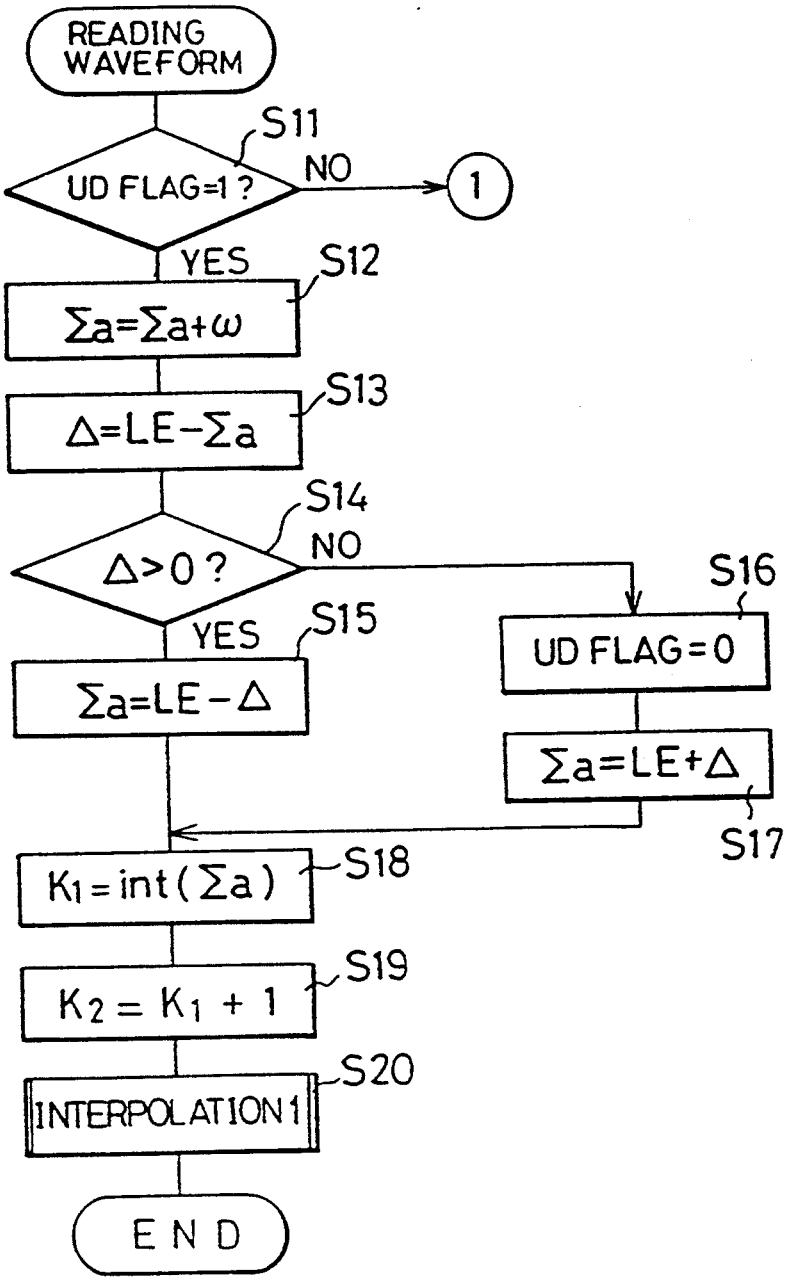
FIG. 4 is a flowchart illustrating the operation of this embodiment of the present invention.
Figure 5:
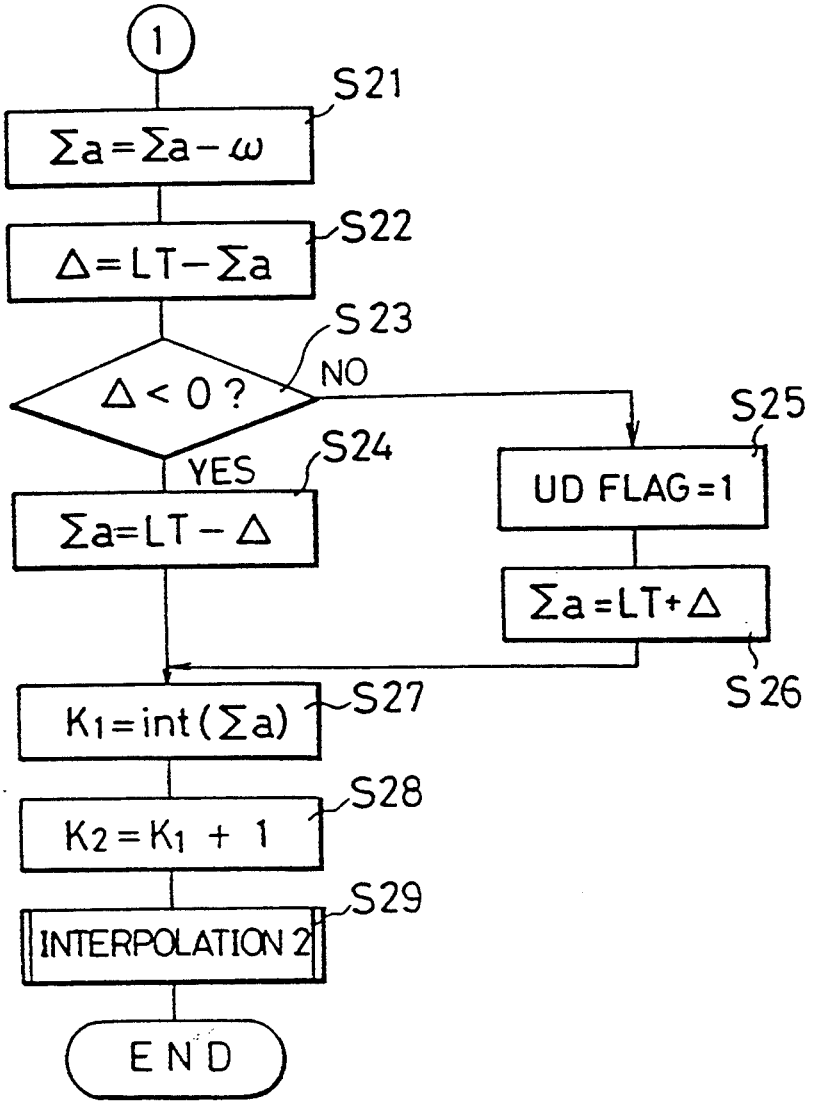
FIG. 5 is a flowchart illustrating a continuation of the flowchart shown in FIG. 4.
Figure 6A:
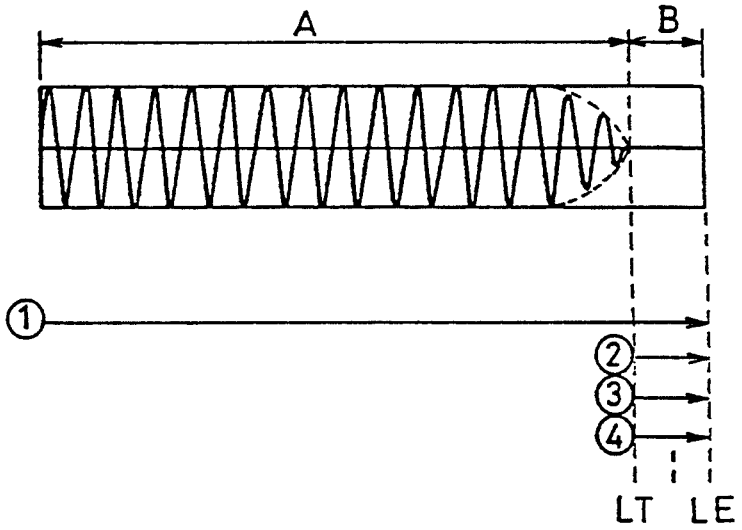
FIG. 6A is a diagram similar to FIG. 2D, indicating a first method for reading out tone waveform data.
Figure 6B:
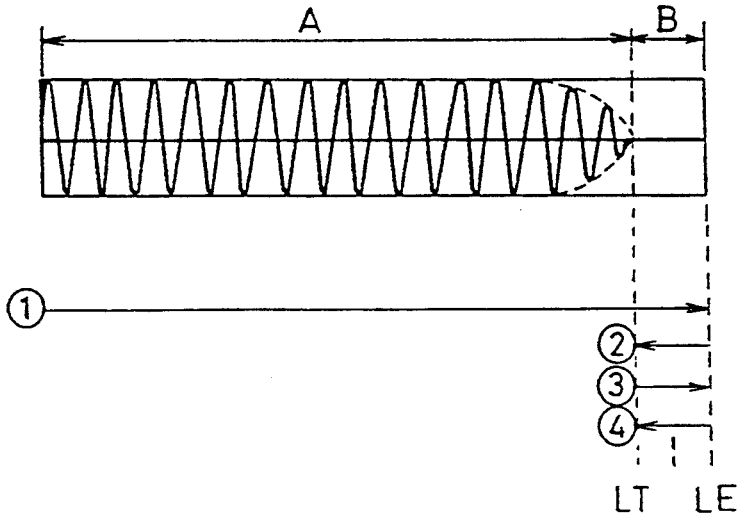
FIG. 6B is a diagram similar to FIG. 2D, indicating a second method for reading out tone waveform data.

The flowcharts shown in FIGS. 4 and 5 are designed for the case where the alternate reading is performed, and the operation in this case is illustrated in FIG. 6B. The normal reading is accomplished by the flowchart shown in FIG. 4 (excluding step S11), and its operation is illustrated in FIG. 6A; however, a description of this operation will not be given here since it is the same as part of the operation for the alternate reading.

The following description will be given on the premise that the tone waveform data shown in FIG. 2C or 2D is stored in the wave memory 8, a UD flag is set to "1" in the initial state and the process for reading out the interval A of tone waveform data has already been completed.

In processing the interval B of tone waveform data, it is first checked if the UD flag is "1" (step S11). The UD flag specifies the reading direction: the upward reading or reading from the loop top LT (hereinafter simply referred to as "LT") toward the loop end LE (hereinafter simply referred to as "LE") when it is "1" and downward reading or reading from the LE toward the LT when it is "0."

When the UD flag is judged to be "1" in step S11, the upward reading and interpolation as described in steps S12 to S20 start.

First, the adder 20 adds the frequency number $\omega$ given from the CPU 4 to the present read address $\Sigma a$ output from the address calculator 21 to calculate the next read address $\Sigma a$ and the resultant address $\Sigma a$ is stored in an internal register (not shown) of the address calculator 21 (step S12).

Then, the next read address $\Sigma a$ obtained in step S12 is subtracted from the LE value set in the LE register 23 to acquire a difference $\Delta$ (step S13). It is then checked if this difference $\Delta$ is greater than zero (step S14). If the difference $\Delta$ is greater than zero, or if the sampling position does not exceed the LE, the difference $\Delta$ is subtracted from the LE to restore the next read address $\Sigma a$ (step S15).

If the difference $\Delta$ is equal to or smaller than zero, or if the sampling position has exceeded the LE, the UD flag is set to "0" to subsequently execute the downward reading and interpolation (step S16). Then, the difference $\Delta$ is added to the LE to provide the next read address $\Sigma a$ (step S17). Since the difference $\Delta$ in this case is negative, the next read address $\Sigma a$ will be at the position apart by $\Delta$ toward the LT from the LE.

This next read address $\Sigma a$ has the same value as the value acquired by adding the frequency number $\omega$ to the present read address $\Sigma a$, if it is considered as a multiple-period waveform obtained by linking multiple-period waveforms at point symmetrical positions, i.e., multiple-period waveforms of opposite phases formed by rotating a multiple-period waveform 180 degrees around the LE.

Then, the integer portion in the next read address $\Sigma a$ calculated in step S15 or S17 is extracted to produce a read address integer portion $K_1$ (step S18), and "1" is added to this integer portion $K_1$ to provide an interpolation integer address $K_2$ (step S19). Next, different pieces of tone waveform data are read out from the wave memory 8 using the next read address Σa, the read address integer portion $K_1$ and the interpolation integer address $K_2$ and interpolation is performed on those data in the interpolating circuit 24 (step S20).

At this time, if the next read address Σa lies within the range of "LE−1≦Σa≦LE," then the interpolation is performed using "LE−1" as the read address integer portion $K_1$ and "LE" as the interpolation integer address $K_2$.

When the UD flag is judged to be "0" in the aforementioned step S11, the downward reading and interpolation as described in steps S21 to S29 start.

First, the adder 20 subtracts the frequency number ω provided by the CPU 4 from the present read address Σa output from the address calculator 21 to calculate the next read address Σa, and the resultant address Σa is stored in the internal register (not shown) of the address calculator 21 (step S21). The read address Σa and frequency number ω both include fraction portions as described earlier.

Then, the next read address Σa obtained in step S21 is subtracted from the LT set in the LT register 22 to acquire a difference Δ (step S22). It is then checked if this difference Δ is smaller than zero (step S23). If the difference Δis smaller than zero, or if the sampling position does not exceed the LT, the difference Δ is subtracted from the LT to restore the next read address Σa (step S24). If the difference Δ is equal to or greater than zero, or if the sampling position is beyond the LT, the UD flag is set to "1" to subsequently execute the upward reading and interpolation (step S25). Then, the difference Δ is added to the LT to provide the next read address Σa (step S26). Since the difference Δ in this case is positive, the next read address Σa will be at the position apart by Δ toward the LE from the LT.

Subsequently, the integer portion in the next read address, Σa calculated in step S24 or S26 is extracted to provide a read address integer portion $K_1$ (step S27), and "1" is added to this integer portion $K_1$ to provide an interpolation integer address $K_2$ (step S28). Then, different pieces of tone waveform data are read out from the wave memory 8 using the next read address Σa, the read address integer portion $K_1$ and the interpolation integer address $K_2$, and interpolation is performed on those data in the interpolating circuit 24 (step S29).

At this time, if the next read address Σa lies within the range defined by "LT≦Σa≦LT+1," then the interpolating circuit 24 performs the interpolation using "LT+1" as the read address integer portion $K_1$ and "LT" as the interpolation integer address $K_2$.

In the interpolation in the downward direction, the phase of the tone waveform data will be inverted, thus providing the same results as provided in the case where a multiple-period waveform is continuously generated with the LE taken as the point of symmetry.

The above processing will be further described referring to FIG. 6B. First, in reading out tone waveform data from the wave memory 8 for tone generation, the reading starts from the top of the tone waveform data, and the interval A and the subsequent interval B are read out only once, as indicated by ① in FIG. 6B.

Then, the interval B between the LT and LE, is read out repetitively in different directions alternately as indicated by ②,③, ... in FIG. 6B. Since the data of the interval B is zero, however, the repetitive reading of this tone waveform data will produce no sound. While this reading operation serves as loop waveform reading, therefore, it will result in the tone generation which is achieved as in the case of reading out a one-shot waveform.

According to the present invention, as described above, in storing tone waveform data into the wave memory 8, first tone waveform data (interval A) with an arbitrary length extracted from the attack portion of a musical tone and second tone waveform data (interval B) with an arbitrary length, which follows the first tone waveform data and has an output of zero when read out for tone generation, are stored in the wave memory 8, and in reading out tone waveform data from the wave memory 8, the interval A is read out first one time, followed by repetitive reading of the interval B.

This operation is the same as the one executed in reading out tone waveform data to produce a normal sustaining sound. Since the contents of the interval B are zero, however, repetitive reading of this interval B will produce no sound. In other words, this operation can achieve a functional equivalent to tone release effected by reading out a one-shot waveform.

Therefore, a circuit for reading out a one-shot waveform need not be provided separately from a read circuit for providing a sustaining sound, but both circuits can be accomplished by a single common circuit, thus reducing the required amount of hardware for a tone generating apparatus.

For easier understanding of the advantages of this embodiment, the embodiment will be described in comparison with the prior art.

Figure 8:
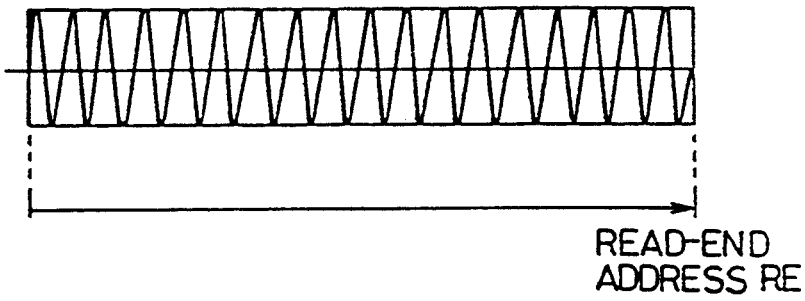
FIG. 8 is a flowchart illustrating the conventional way of reading a one-shot waveform.

The conventional way of reading a one-shot waveform is accomplished by preparing tone waveform data for generation of musical tones with a short period in advance in the wave memory, and reading the tone waveform data from the top to a read-end address RE once as shown in FIG. 8.

In this case, the read-end address RE is additionally defined to distinguish this reading from the above-described reading for a sustaining sound. A read stop circuit is additionally provided to stop reading data, so that this circuit will disable the reading operation when the reading of tone waveform data up to the read-end address RE is completed.

Figure 9:
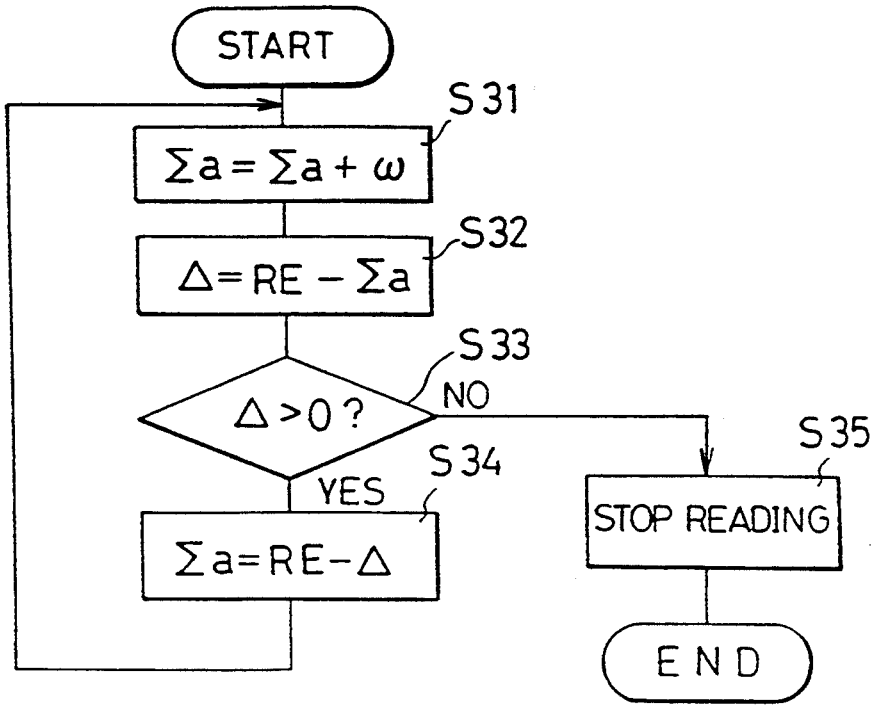
FIG. 9 is a flowchart illustrating the conventional way of reading a one-shot waveform.

FIG. 9 illustrates in the form of a flow chart the operation of the above circuit for reading a one-shot waveform. This operation requires an RE register for holding the read-end address RE, an address calculator with a temporary register incorporated thereinto, an adder, and a control circuit for controlling those components, though a circuit diagram for them is not given.

First, the adder adds the frequency number ω provided by the CPU to the present read address Σa output from the address calculator to calculate the next read address Σa and the resultant address Σa is stored in the temporary register in the address calculator (step S31).

Then, the next read address Σa obtained in step S31 is subtracted from the value of the read-end address RE set in the RE register to acquire a difference Δ (step S32). It is then checked if this difference Δ is greater than zero (step S33). If the difference Δ is greater than zero, or if the sampling position does not exceed the read-end address RE, the difference Δ is subtracted from the read-end address RE to restore the next read address Σa (step S34). The flow then returns to step S31 to repeat the same procedures.

If the difference Δ is judged equal to or smaller than zero in the repetitive execution of the above sequence of processes, i.e., if the sampling position has exceeded the read-end address RE, the reading will be terminated considering that the reading of a series of tone waveform data has completed (step S35).

In short, while the conventional tone generating apparatus requires two types of read circuits: one for reading loop waveform data for generation of a sustaining sound and the other for accomplishing the reading of a one-shot waveform, this embodiment eliminates the need for the circuit for reading a one-shot waveform, thus resulting in hardware reduction.

Although this embodiment is designed to directly cut out original data shown in FIG. 2A to provide data of the attack portion of a musical tone, it is desirable that the fetched original data be resampled to produce new original data before producing the above-described tone waveform, data. This is because the fetched data may have a fluctuating pitch, so that the direct use thereof for generation of tone waveform data could generate a musical tone that is out of tune. The suggested resampling of the original data, if performed to adjust the tuning pitch before yielding new original data, can provide better musical tones.

As described above, the present invention can provide a tone generating apparatus which uses a common circuit to read out to waveform data for generation of a sustaining sound and read out a one-shot waveform, so that the apparatus can be manufactured with fewer circuits, resulting in cost reduction.

This invention is clearly new and useful. Moreover, it was not obvious to those of ordinary skill in the art at the time it was made, in view of the prior art when considered as a whole.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A tone generating apparatus, comprising:

a wave memory within which is stored a plurality of first tone waveform data each of which has a preselected length extracted from an attack portion of a corresponding plurality of musical tones and a plurality of second tone waveform data each of which has a preselected length following associated first tone waveform data;

read means for reading a selected first tone waveform data of said plurality of first waveform data only once from said wave memory and subsequently reading associated second tone waveform data of said plurality of second waveform data repeatedly;

a first predetermined plurality of said plurality of second waveform data having a value of zero so that no musical tone is produced when said first predetermined plurality of second waveform data is read repeatedly and a second predetermined plurality of second waveform data having a value that non-zero so that sustaining musical tones are produced when said second predetermined plurality of second waveform data is read repeatedly;

tone generating means for generating a musical tone based on said tone waveform data read out by said read means;

whereby said read means is the only read means required to read musical tones having sustaining portions and musical tones not having sustaining portions.

2. A tone generating apparatus according to claim 1, wherein each first tone waveform data of said plurality of first tone waveform data stored in said wave memory is prepared by pulse code modulation of an original tone.

3. A tone generating apparatus according to claim 1, wherein each first tone waveform data of said plurality of first waveform data stored in said wave memory is prepared by normalizing an envelope when an original tone has attenuating property.

4. A tone generating apparatus according to claim 1, wherein with reference to each first tone waveform data of said first plurality of waveform data stored in said wave memory, an arbitrary interval adjacent each second tone waveform data of said plurality of second waveform data is prepared to attenuate tone waveform data.

5. A tone generating apparatus according to claim 1, wherein said read means repeatedly reads each second tone waveform data of said plurality of second waveform data in one direction, following reading of associated first tone waveform data of said plurality of first waveform data.

6. A tone generating apparatus according to claim 11, wherein said read means repeatedly reads each second tone waveform data of said plurality of second waveform data in first and second directions, following reading of associated first tone waveform data of said plurality of first waveform data.

* * * * *

UNITED STATES PATENT AND TRADEMARK OFFICE

CERTIFICATE OF CORRECTION

PATENT NO. : 5,288,940

DATED : February 22, 1994

INVENTOR(S) : Gen Izumisawa

It is certified that error appears in the above-indentified patent and that said Letters Patent is hereby corrected as shown below:

Claim 1, Column 10, Line 15, change "that non-zero" to --that is non-zero--.

Claim 6, Column 10, Line 49, change "claim 11" to --claim 1--.

Signed and Sealed this

Eighteenth Day of April, 1995

Bruce Lehman

*Attest:*

BRUCE LEHMAN

*Commissioner of Patents and Trademarks*

*Attesting Officer*